US008418747B2

(12) United States Patent
Terada

(10) Patent No.: US 8,418,747 B2
(45) Date of Patent: Apr. 16, 2013

(54) APPARATUS AND METHOD FOR FEEDING INOCULANTS INTO A FLOW OF MOLTEN METAL AND AUTOMATIC MOLTEN METAL POURING MACHINE

(75) Inventor: Hideto Terada, Nagoya (JP)
(73) Assignees: Sintokogio Ltd., Aichi (JP); Fujiwa Denki Co., Ltd., Aichi (JP)

( * ) Notice: Subject to any disclaimer, the term of this patent is extended or adjusted under 35 U.S.C. 154(b) by 0 days.

(21) Appl. No.: 13/382,434

(22) PCT Filed: Jun. 15, 2010

(86) PCT No.: PCT/JP2010/060110
§ 371 (c)(1),
(2), (4) Date: Jan. 5, 2012

(87) PCT Pub. No.: WO2011/004685

PCT Pub. Date: Jan. 13, 2011

(65) Prior Publication Data

US 2012/0097355 A1 Apr. 26, 2012

(30) Foreign Application Priority Data

Jul. 6, 2009 (JP) ..... 2009-159585
May 13, 2010 (JP) ..... 2010-110803

(51) Int. Cl.

| | |
|---|---|
| ***B22D 46/00*** | (2006.01) |
| ***B22D 27/00*** | (2006.01) |
| ***B22D 39/04*** | (2006.01) |
| ***B22D 1/00*** | (2006.01) |
| ***B22C 9/20*** | (2006.01) |

(52) U.S. Cl.
USPC .... 164/457; 164/55.1; 164/155.7; 164/270.1; 164/322; 266/216

(58) Field of Classification Search ..... 164/55.1, 164/56.1, 57.1, 58.1, 457, 270.1, 322, 155.1, 164/155.7; 266/216
See application file for complete search history.

(56) References Cited

U.S. PATENT DOCUMENTS

| | | | | |
|---|---|---|---|---|
| 3,224,051 | A * | 12/1965 | Brown, Jr. et al. | 164/57.1 |
| 4,352,605 | A * | 10/1982 | Godding et al. | 406/29 |
| 5,129,629 | A * | 7/1992 | Christensen | 266/81 |
| 5,285,934 | A * | 2/1994 | Yamauchi et al. | 222/595 |
| 7,354,549 | B2 * | 4/2008 | Watanabe et al. | 420/32 |
| 2010/0116855 | A1 | 5/2010 | Noda et al. | |

FOREIGN PATENT DOCUMENTS

| | | | |
|---|---|---|---|
| JP | 55-153651 | A | 11/1980 |
| JP | 60-250855 | A | 12/1985 |
| JP | 2008-290148 | A | 12/2008 |

OTHER PUBLICATIONS

International Search Report dated Aug. 31, 2010 issued in corresponding International Application No. PCT/JP2010/060110.

* cited by examiner

*Primary Examiner* — Kevin P Kerns
(74) *Attorney, Agent, or Firm* — Finnegan, Henderson, Farabow, Garrett & Dunner, L.L.P.

(57) ABSTRACT

An inoculant feeding method and apparatus in which a desired amount of inoculants can be fed into molten metal poured into a mold by an automatic molten metal pouring machine, and an automatic molten metal pouring machine using the apparatus. An inoculant feeding apparatus (1) feeds inoculants into molten metal poured into a mold (2) from an automatic molten metal pouring machine (20), at a predetermined proportion corresponding to the amount of the poured molten metal which gradually varies. The apparatus (1) is provided with a hopper (8) which is attached to a truck (6) and which stores the inoculants, a screw conveyor (9) attached to a lower end of the hopper, a drive mechanism (10) which is attached to a base end of the screw conveyor and which drives the screw driver, and a controller (30) which controls the drive mechanism. Due to the control by the controller (30), the screw conveyor (9) is driven through the drive mechanism (10), corresponding to the amount of the molten metal poured from the automatic molten metal pouring machine (20) so that the inoculants are fed from the screw conveyor (9) into the molten metal poured into the mold (2) from the automatic molten metal pouring machine (20).

4 Claims, 5 Drawing Sheets

APPARATUS AND METHOD FOR FEEDING INOCULANTS INTO A FLOW OF MOLTEN METAL AND AUTOMATIC MOLTEN METAL POURING MACHINE

BACKGROUND

Cross Reference to Related Applications

This application claims the priorities of Japanese Patent Applications No. 2009-159585, filed Jul. 6, 2009 and No. 2010-11803, filed May 13, 2010. All their disclosures are incorporated herein by reference.

TECHNICAL FIELD

The resent invention relates to an apparatus and a method for feeding inoculants into a flow of molten metal and an automatic molten metal pouring machine.

Generally, to produce a casting product, inoculants are fed into a stream of molten metal to be poured into a mold such that material of the molten metal is prepared.

Specifically, the inoculants are penetrated into the molten metal that has been poured into the mold by means of an automatic molten metal pouring machine in a predetermined proportion to obtain a casting product having a predetermined hardness. However, it is difficult to feed the inoculants to the molten metal with the predetermined proportion and thus may cause a problem in which, for instance, the variation of the hardness of the casting products is increased. Therefore, it is preferable to overcome the above problem, since there is neither an apparatus nor a method for appropriately feeding the inoculants into the molten metal that has been poured into the mold.

SUMMARY OF INVENTION

Means to Solve the Problem

An objective of the present invention is to provide a method and an inoculation apparatus for feeding a predetermined quantity of inoculants into a flow of molten metal to be poured into a mold by means of an automatic molten metal pouring machine, and the automatic molten metal pouring machine that uses the inoculation apparatus.

Means to Solve the Problem

The inoculation apparatus of the present invention feeds inoculants to molten metal that has been poured from an automatic molten metal pouring machine into a mold in a predetermined proportion that corresponds to the quantity of the molten metal that has been poured into the mold with a gradual variation. The inoculation apparatus comprising:

a traveling means for traveling along a pouring line in which a plurality of flasks, each of which contains a mold, are arranged in a line;

a holding means for holding inoculants, wherein the holding means is mounted on the traveling means;

a feeding means for receiving the inoculants to be fed to the mold from the holding means and feeding the received inoculants, wherein the feeding means is located beneath the holding means;

a driving means, which is drivingly connected to the feeding means, for driving the feeding means; and a controlling means for controlling the driving means;

wherein the controlling means drives the feeding means through the driving means based on the quantity of the molten metal to be poured into the mold such that the inoculants are fed from the feeding means to the molten metal to be poured into the mold from the automatic molten metal pouring machine. In one embodiment of the present invention, the automatic molten metal pouring machine includes a ladle, and wherein the inoculation apparatus further includes a detecting means for detecting the flow rate of the molten metal to be poured into the mold from the ladle and for generating a signal corresponding to the detected flow rate such that the controlling means controls the driving means based on the signal from the detecting means. Alternatively, the inoculation apparatus may further include a load cell for detecting the weight of the molten metal in the ladle and for generating a signal that indicates the detected weight such that the controlling means controls the driving means based on the signal from the load cell.

In this configuration, preferably, the controlling means includes:

a first calculating means for calculating the weight of the molten metal in the ladle based on the signal from the load cell;

a second calculating means for calculating the flow rate of the molten metal that has been poured from the ladle into the mold;

an injected-quantity determining means for determining the injected quantity of the inoculants based on the result of the calculation of the second calculating means; and a driving-indicating means for determining the amount of driving of the driving means such that the feeding means is driven based on the determined injected quantity of the inoculants that is determined by the injected-quantity determining means.

In the embodiment using the load cell, the load cell may be located beneath the ladle. The controlling means controls the ladle based on the signal from the ladle, while the controlling means controls the inoculation apparatus such that the inoculants are fed into the molten metal in a proportion that corresponds to the quantity of the molten metal that has been poured from the ladle into the mold.

The method for feeding inoculants of the present invention feeds inoculants from an inoculation apparatus to molten metal that has been poured from an automatic molten metal pouring machine into a mold, wherein the inoculation apparatus includes a holding means, which is mounted on a traveling means for traveling along a pouring line in which a plurality of flasks, each containing a mold, are arranged in a line, for holding the inoculants, a feeding means, which is located beneath the holding means, for receiving the inoculants to be fed to the mold from the holding means and feeding the received inoculants, a driving means, which is drivingly connected to the feeding means, for driving the feeding means, and a controlling means for controlling the driving means. The method comprises controlling the driving means by the controlling means such that the inoculants are fed, through the feeding means, into the molten metal poured from the automatic molten metal pouring machine into the mold, in a predetermined proportion that corresponds to a quantity of the molten metal poured in a gradual variation.

Advantage of the Invention

With the present invention, to the molten metal that has been poured into the mold from the automatic molten metal pouring machine, the inoculants can be fed with the predetermined proportion corresponding to the quantity of the molten metal poured in a gradual variation such that the injected quantity of the inoculants can be reduced to the optimal quantity. Therefore, the present invention provides beneficial advantages in that a contribution of a cost reduction of the casting products and a reduction of the incidence of defective casting products due to a variation in the hardness can be achieved.

The accompanying drawings, which are incorporated in and constitute a part of the specification, schematically illustrate a preferred embodiment of the present invention, and together with the general description given above and the detailed description of the preferred embodiment given below, serve to explain the principles of the present invention.

EMBODIMENT TO CARRY OUT INVENTION

Figure 1:
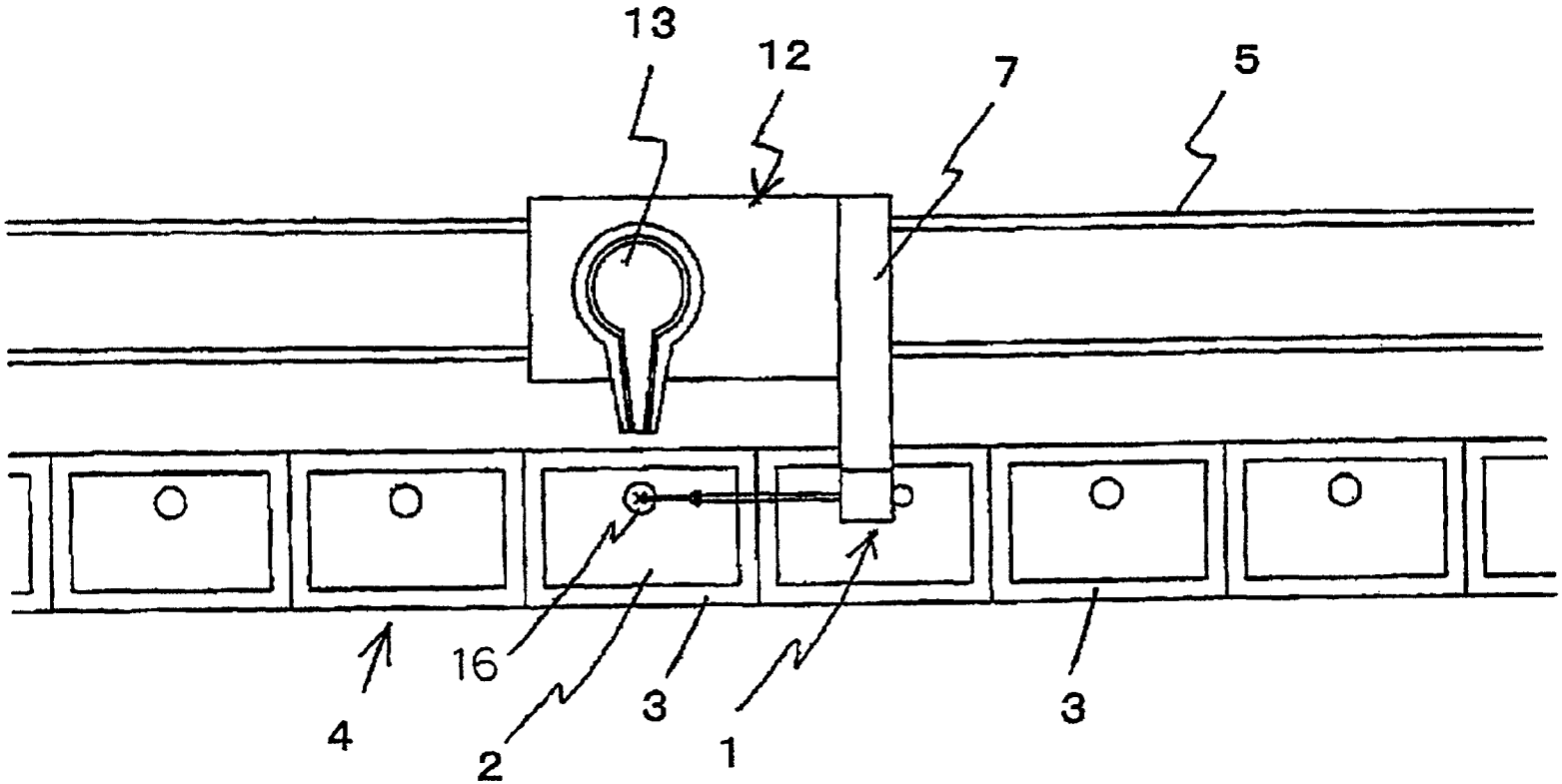
FIG. 1 is a plan view of one embodiment, in which the present invention is applied, of an inoculation apparatus for feeding inoculants to molten metal.
Figure 2:
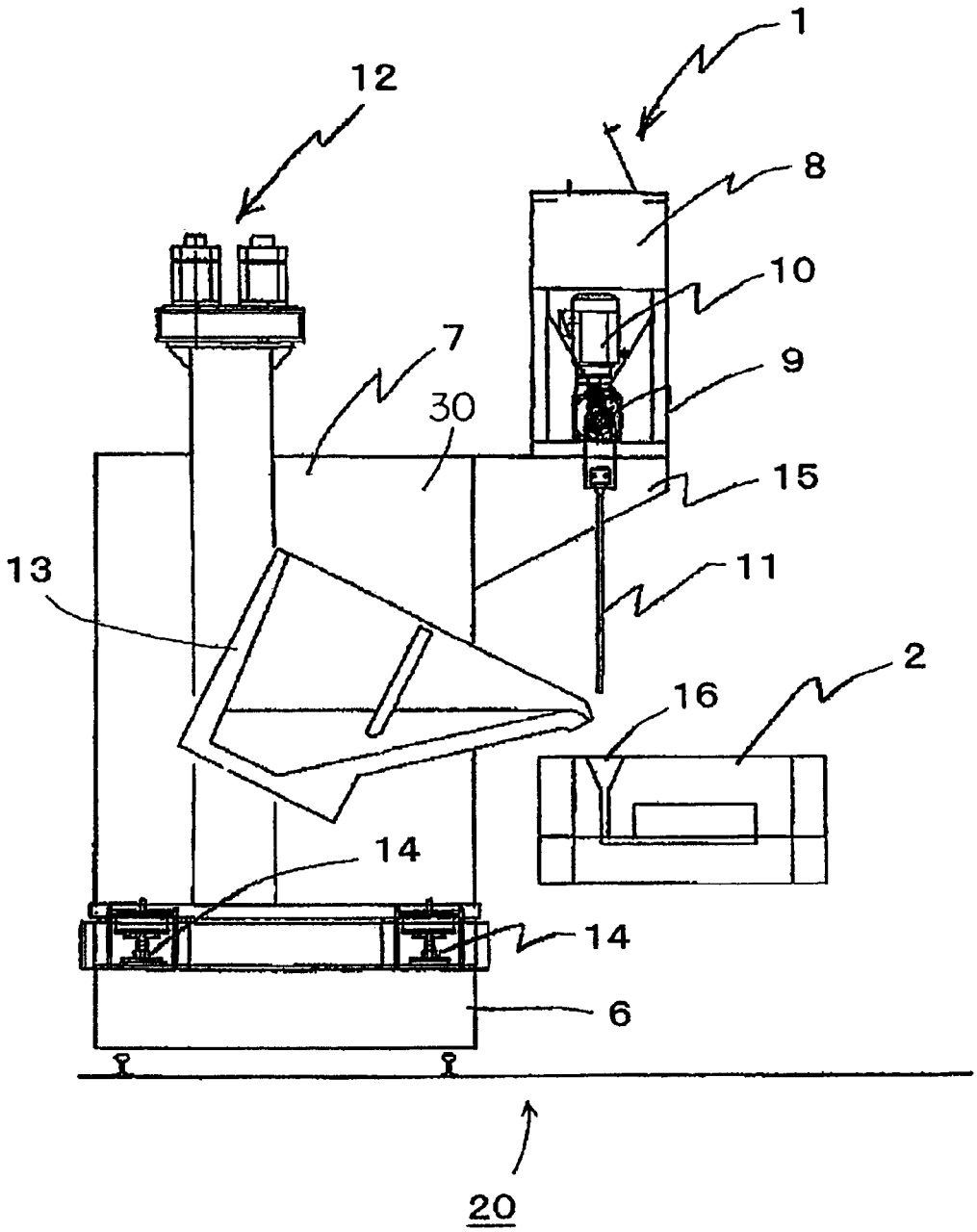
FIG. 2 is an enlarged view of the left side of the inoculation apparatus of FIG. 1 with a partially broken view.
Figure 3:
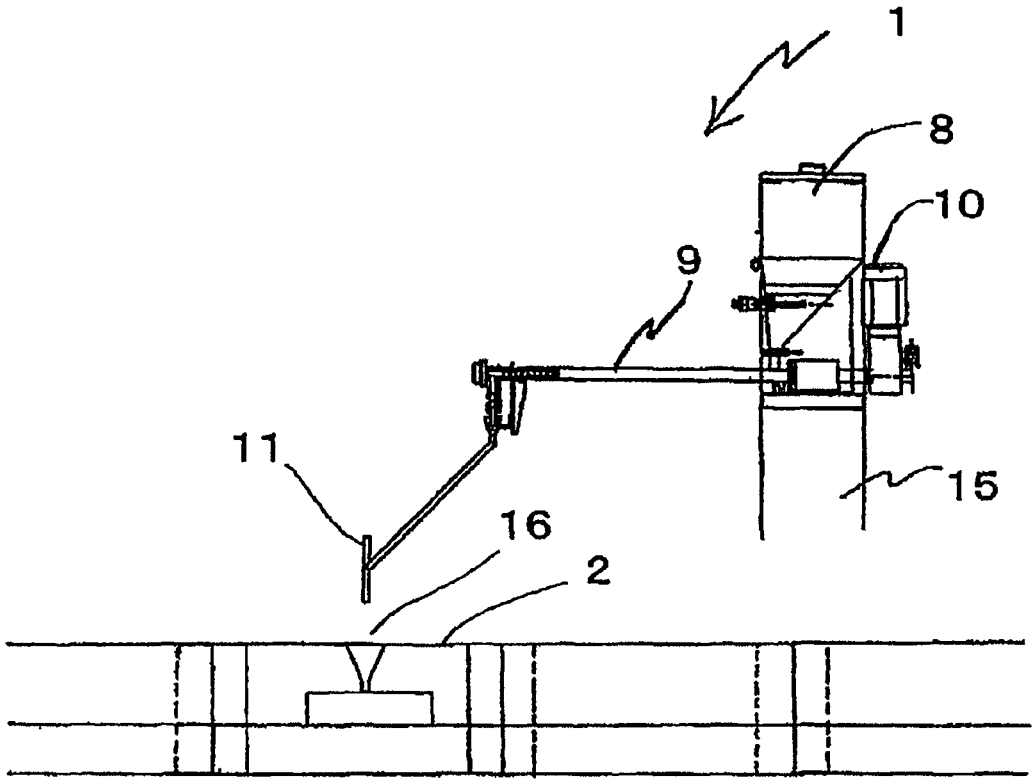
FIG. 3 is an enlarged and front view of the inoculation apparatus of FIG. 1.

By reference to FIGS. 1, 2, and 3, an inoculation apparatus 1 for feeding inoculants into molten metal, an automatic molten metal pouring machine 20 using the apparatus 1, and a method for feeding inoculants into molten metal, according to the present invention are described. As illustrated in FIG. 1, the inoculation apparatus 1 feeds inoculants in a predetermined portion into the molten metal poured into a mold 2. The inoculation apparatus 1 is mounted on rails 5. The rails 5 are laid in line with a pouring line 4 in which a plurality of flasks 3, each of which contains a mold, are arranged in a line such that the inoculation apparatus reciprocatingly moves along the pouring line 4.

As illustrated in FIGS. 2 and 3, the inoculation apparatus 1 includes a holding means such as, a hopper 8 for storing and holding inoculants. The inoculation apparatus 1 is mounted on a control panel 7 by a holding member 15, the control panel 7 is mounted on a traveling means such as a traveling truck 6 moving on the rails 5. The apparatus 1 also includes a feeding means such as a screw conveyor 9, which is mounted on the lower end of the hopper 8, for receiving the inoculants from the hopper 8, a driving means such as a driving mechanism 10, which is mounted on the proximal end of the screw conveyor 9, for driving the screw conveyor 9 such that the screw conveyor 9 conveys the received inoculants, and a chute 11, which is mounted on a tip end of the screw conveyor 9 for feeding the inoculants. The control panel 7 is provided with a controlling means such as a controller 30 for controlling the driving mechanism 10 for various types of devices.

As illustrated in FIG. 2, a main unit 12 of an automatic molten metal pouring machine is mounted on the traveling truck 6. The main unit 12 of the automatic molten metal pouring machine includes a tilting-type ladle 13 and a load cell 14, which is mounted on the lower portion of the ladle 13, for detecting a quantity of molten metal therein. The main unit 12 of the automatic o'ten metal pouring machine includes an automatic molten metal pouring machine 20 for pouring the molten metal into a mold 2 together with the inoculation apparatus 1.

Figure 4:
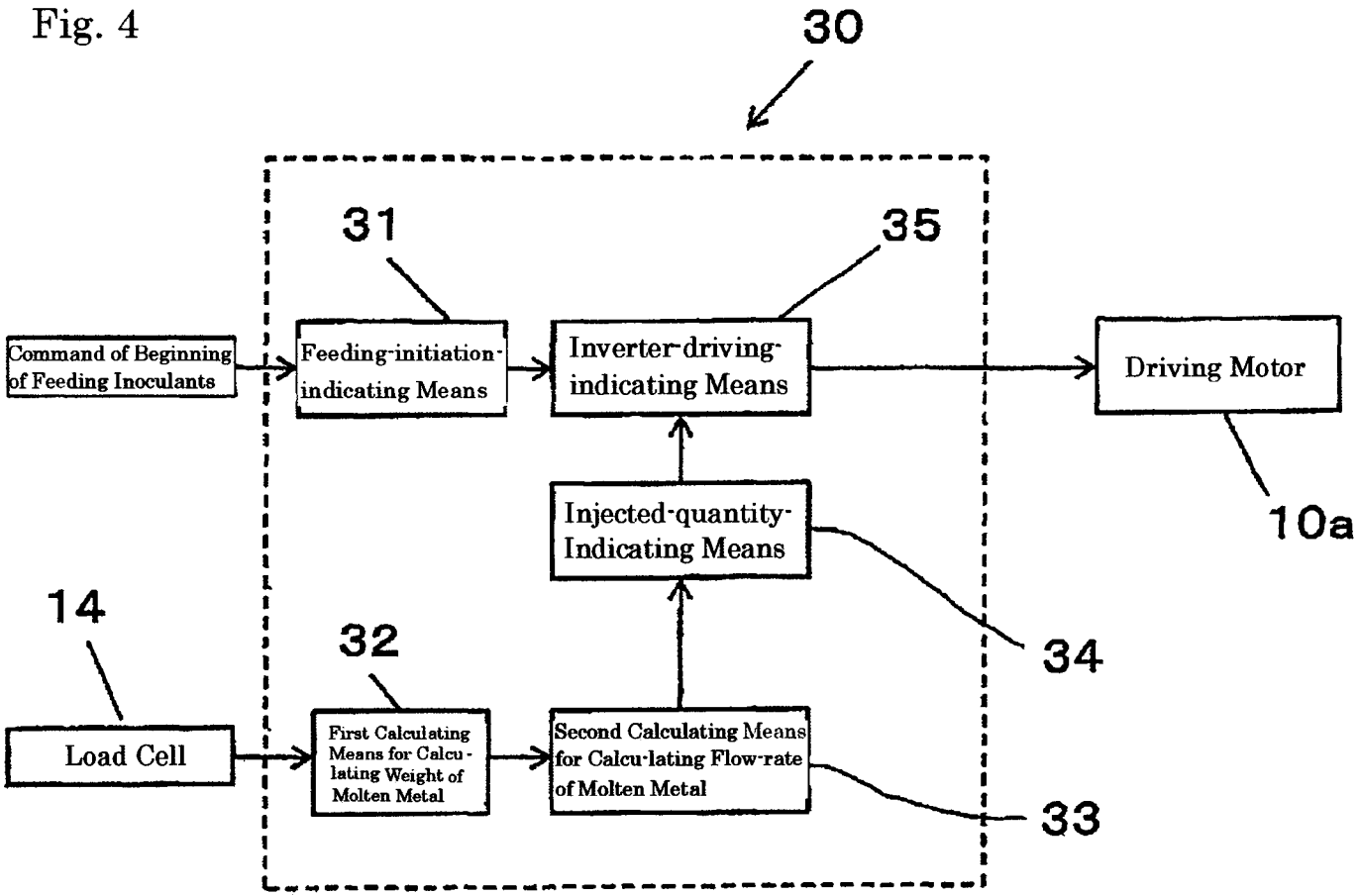
FIG. 4 is a block diagram of one example of a controller of the inoculation apparatus.

The controller 30, which is provided with the control panel 7, controls the driving mechanism 10 in response to a signal from the load cell 14 for detecting the weight of the molten metal in the ladle 13. Specifically, for instance, as illustrated in FIG. 4, the controller 30 includes an initiation-feeding-indicating means 31 for indicating the initiation of feeding the inoculants in response to a command of the beginning of feeding the inoculants, an inverter-driving-indicating means 35 for indicating the applying of a predetermined alternating voltage on the driving motor 10*a* of the driving mechanism 10, a first calculating means 32 for calculating the weight of the molten metal in the ladle 13 based on the detected value from the load cell 14, a second calculating means 33 for calculating the flow rate of the molten metal that is being poured from the ladle 13 into the mold 2 in response to the variation of the weight of the molten metal in the ladle 13 based on a signal that indicates the value of the calculated weight, an injected-quantity indicating means 34 for determining an injected quantity of the inoculants corresponding to the flow rate of the molten metal that is being poured based on a signal that indicates the calculated value of the flow rate of the molten metal that is being poured, and indicating the determined injected quantity of the inoculants to be added, to the inverter-driving-indicating means 35. The inverter-driving-indicating means 35 determines the amount of the driving of the driving mechanism 10 for driving the screw conveyor 9 based on the signal that indicates the injected quantity that is determined by the injected-quantity indicating means 34 such that the inverter-driving-indicating means 35 controls the driving motor 10*a* in response to the corresponding indicating signal.

In the controller 30, first, the weight of the molten metal is calculated in response to the command to begin feeding of the inoculants and the signal from the load cell 14, then the flow rate of the molten metal that is being poured is determined, then the injected quantity of the inoculants is determined, and then the driving motor 10*a* of the driving mechanism 10 is driven and controlled based on the determined injected quantity.

Also, in this embodiment, the controller 30 of the automatic molten metal pouring machine 20 is configured such that it controls the ladle 13 based on the signal from the load cell 14. Specifically, the controller 30 controls the tilting velocity and the tilting position of the ladle 13 by controlling a driving motor (not shown) and so on of the ladle 13, while the controller 30 observes the flow rate of the molten metal that is poured, which is calculated by the second calculating means 33. The controller 30 can thus further appropriately control the quantity of the molten metal to be poured into the mold. Alternatively, a further controller for controlling the tilting velocity and the tilting position of the ladle 13 may be provided separately from the controller 30. However, as described herein, it is preferable that the single controller 30 concurrently control the ladle 13 and the driving mechanism 10 of the screw conveyor 9, since highly accurate control of the quantity of the molten metal that is poured and the injected quantity of the inoculants can be achieved with a simple configuration.

The inoculation apparatus 1 that is configured as described above detects and measures the quantity of the molten metal that is poured by means of the load cell 14, under the control of the controller 30 of the control panel 7. Simultaneously, the inoculation apparatus 1 causes the ladle 13 of the main unit 12 of the pouring machine to pour the molten metal into the mold 2. Under the control of the control panel 7, the inoculation apparatus 1 controls the number of rotations and the time of rotations of the driving motor 10*a* of the driving mechanism 10, while the inoculation apparatus 1 drives the screw conveyor 9 such that the inoculations are fed to the molten metal 16 poured into the mold from the chute 11 of the screw conveyor 9 with the predetermined proportion that corresponds to the quantity of the molten metal poured in a gradual variation. Namely, the controller 30 drives the screw conveyor 9 through the driving mechanism 10 corresponding to the quantity of the molten metal that has been poured from the ladle 13 of the main unit 12 of the automatic molten metal pouring machine such that an appropriate quantity of the inoculants are fed to the molten metal.

The inoculation apparatus 1 and the method for feeding the inoculants using the apparatus 1 of this embodiment are equipped with the hopper 8, the screw conveyor 9, the driving mechanism 10, and the controller 30. Under the control of the controller 30, the screw conveyor 9 is driven through the driving mechanism 10 corresponding to the quantity of the molten metal that has been poured from the ladle 13 of the main unit 12 of the automatic molten metal pouring machine such that the inoculants feeding from the screw conveyor 9 are fed to the molten metal 16 poured into the mold 2 from the ladle 13 of the main unit 12 of the automatic molten metal pouring machine. Therefore, the inoculants can be fed into the molten metal poured into the mold from the automatic molten metal pouring machine with the predetermined proportion corresponding to the quantity of the molten metal poured in a gradual variation such that the injected quantity of the inoculants can be reduced to the optimal quantity. Therefore, a contribution to the cost reduction of the casting products and a reduction of the incidence of defective casting products due to a variation in the hardness can be achieved.

The inoculation apparatus 1 is configured such that the controller 30 controls the driving mechanism 10 based on the signal from the load cell 14 for detecting the weight of the molten metal in the ladle 13 to achieve the automation of feeding the inoculants with a simple configuration, and the inoculants can be fed with a proportion appropriately corresponding to the quantity of the molten metal to be poured in a gradual variation. Also, in this embodiment, the controller 30 includes the initiation-feeding-indicating means 31 for indicating the initiation of feeding the inoculants in response to a command of the initiation of feeding the inoculants, the first calculating means 32 for calculating the weight of the molten metal, the second calculating means 33 for calculating the flow rate of the molten metal that has been poured, the injected-quantity indicating means 34, which has a function for determining the injected quantity of the inoculants, and the inverter-driving-indicating means 35, which has a function for determining the amount of the driving of the driving mechanism 10 such that an automatization of the in-stream inoculation can be achieved with the simplified configuration to feed the inoculants to the molten metal with a proportion that appropriately corresponds to the quantity of the molten metal poured in a gradual variation.

Further, the automatic molten metal pouring machine 20 that is provided with the inoculation apparatus 1 constitutes the configuration in which the ladle 13 and the load cell 14 are provided such that the controller 30 controls the ladle 13 based on the signal from the load cell 14, while the inoculants are fed to the molten metal with a predetermined proportion that corresponds to the quantity of the molten metal poured from the ladle 13. With this configuration, the automatization of pouring the molten metal and feeding the inoculants can be achieved with a further simplified configuration to feed the inoculants to the molten metal with a proportion that appropriately corresponds to the quantity of the molten metal poured in a gradual variation. Therefore, a further reduction in the incidence of the defective casting products can be achieved.

Figure 5:
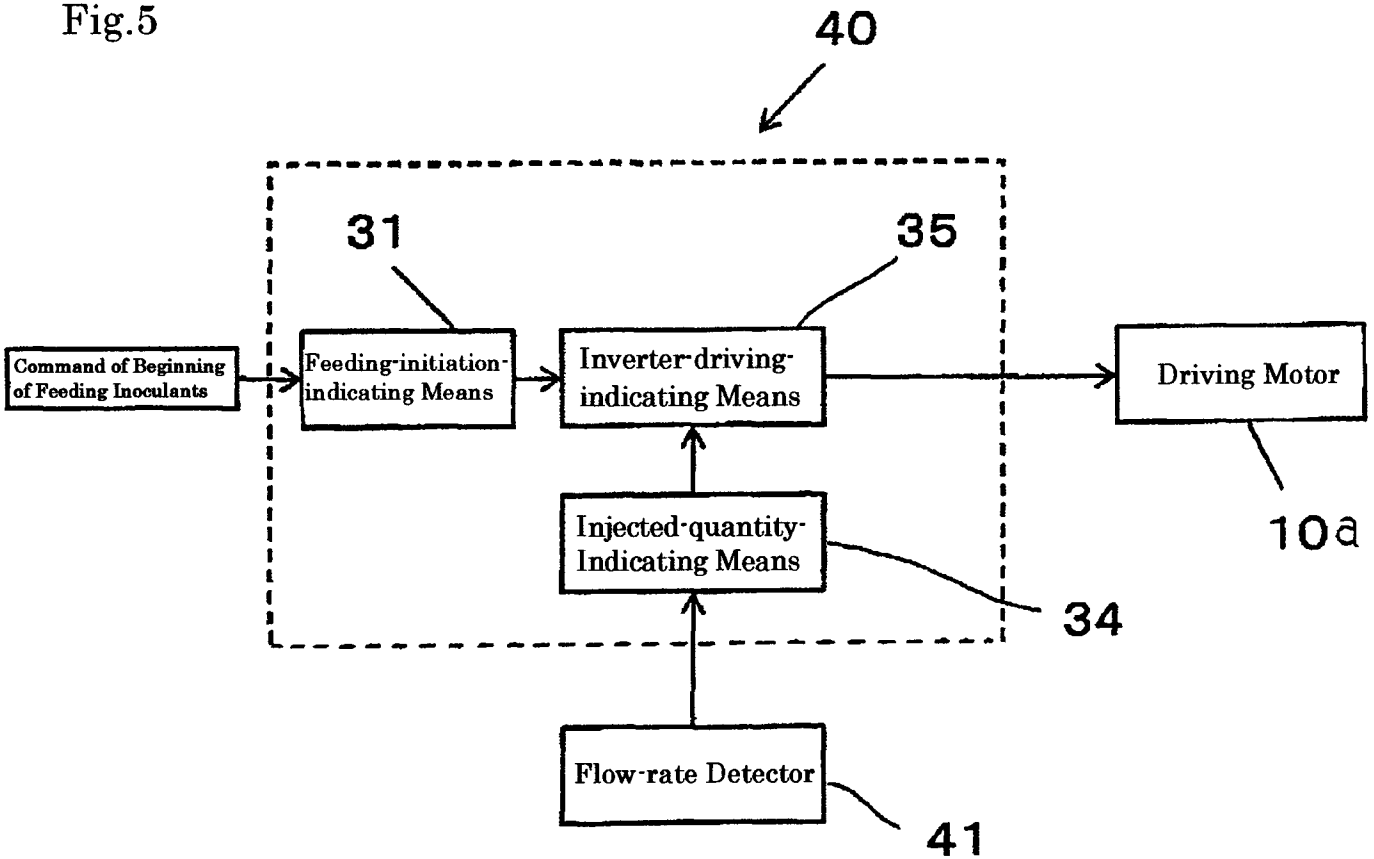
FIG. 5 is a block diagram of other example of the controller similar to FIG. 4.

In the above embodiment, although the controller of the inoculation apparatus uses the controller 30 as illustrated in FIG. 4, the present invention is not intended to limit it. Alternatively, for instance, a controller 40 as illustrated in FIG. 5, substitutes for the controller 30 of FIG. 4. In this controller 40, a detecting means such as a flow-rate detector 41 for detecting the flow rate of the molten metal poured from the ladle 13 is provided as a substitute for the load cell 14, the first calculating means 32, and the second calculating means 33 of the controller 30 as illustrated in FIG. 4. The flow-rate detector 41 may be, for instance, a video camera as an imaging device. The video camera may be positioned laterally or in front of the ladle 13 to capture and thus measure, for instance, the falling position of the molten metal poured and the width of the molten metal that flows from a sprue such that the flow rate of the molten metal poured can be detected. Other arrangements of the controller 40 are similar to those described in reference to the controller 30 of FIG. 4 and include the initiation-feeding-inoculations indicating means 31, the injected-quantity indicating means 34, and the inverter-driving-indicating means 35. The injected-quantity indicating means 34 of the controller 40 determines the injected quantity of the inoculants that corresponds to the flow rate of the molten metal based on the signal from the flow-rate detector 41 and indicates the detected flow rate of the molten metal that has been poured. The injected-quantity indicating means 34 then indicates the determined quantity of the inoculants to be fed to the inverter-driving indicating means 35. The inoculation apparatus 1 that is configured with the controller 40 as illustrated in FIG. 5 controls the driving mechanism 10 based on the signal from the flow-rate detector 41 for detecting the flow rate of the molten metal poured from the ladle into the mold such that an automatization of an inoculation can be achieved with the simplified configuration to feed the inoculants to the molten metal in a proportion that appropriately corresponds to the quantity of the molten metal poured in a gradual variation. Further, the injected quantity of the inoculants can be reduced to the optimal quantity. Therefore, a contribution to the cost reduction of the casting products and a reduction of the incidence of defective casting products due to a variation in the hardness can be achieved.

Some embodiments of the present invention are described above. Nevertheless, it will be understood that various modifications, variations, and alternatives may be made without departing from the spirit and scope of the invention. For example, the means for traveling along the pouring line 4, the means for holding the inoculants, and the means for conveying the inoculants are not limited to the illustrative shapes of the traveling truck 6, the hopper 8, and the screw conveyor 9 having the chute 11 for the convenience of the explanations. The appended claims are intended to include an embodiment in which these elements are replaced with equivalents.

The invention claimed is:

1. An inoculation apparatus for feeding inoculants to molten metal that has been poured from an automatic molten metal pouring machine having a ladle into a mold in a predetermined proportion that corresponds to the quantity of the molten metal that has been poured and is progressively varied, the inoculation apparatus comprising:

a traveling means for traveling along a pouring line in which a plurality of flasks, each of which contains a mold, are arranged in a line;

a holding means for holding inoculants, wherein the holding means is mounted on the traveling means;

a feeding means for receiving the inoculants to be added to the molten metal in the mold from the holding means and feeding the received inoculants, wherein the feeding means is located beneath the holding means;

a driving means, which is drivingly connected to the feeding means, for driving the feeding means;

a controlling means for controlling the driving means; and a load cell for detecting a weight of the molten metal in the ladle of the automatic molten metal pouring machine and for generating a signal that indicates the detected weight;

wherein the controlling means determines an amount of the driving of the driving means by a calculation based on the signal from the load cell to control the driving means, while the controlling means drives the feeding means through the driving means based on the quantity of the molten metal that has been poured into the mold such that the inoculants are added from the feeding means into the molten metal poured into the mold from the automatic molten metal pouring machine in a proportion that corresponds to the quantity of the molten metal that has been poured from the ladle into the mold.

2. The inoculation apparatus of claim 1, wherein the controlling means includes:

a first calculating means for calculating a weight of the molten metal in the ladle based on the signal from the load cell;

a second calculating means for calculating a flow rate of the molten metal being poured from the ladle into the mold;

an injected-quantity determining means for determining an injected quantity of the inoculants based on the result of the calculation of the second calculating means; and a driving-indicating means for determining the amount of the driving of the driving means such that the feeding means is driven based on the injected quantity of the inoculants that is determined by the injected-quantity determining means.

3. An automatic molten metal pouring machine that is provided with the inoculation apparatus of claim 1 or 2, wherein the load cell is located beneath the ladle, and wherein the controlling means or a further controlling means controls a tilting velocity and a tilting position of the ladle based on the signal from the load cell.

4. A method for feeding inoculants from an inoculation apparatus to molten metal that has been poured from an automatic molten metal pouring machine having a ladle into a mold, wherein the inoculation apparatus includes a holding means, which is mounted on a traveling means for traveling along a pouring line in which a plurality of flasks, each of which contains a mold, are arranged in a line, for holding the inoculants, a feeding means, which is located beneath the holding means, for receiving the inoculants to be added to the molten metal in the mold from the holding means and feeding the received inoculants, a driving means, which is drivingly connected to the feeding means, for driving the feeding means, a controlling means for controlling the driving means and a load cell for detecting a weight of the molten metal in the ladle of the automatic molten metal pouring machine and for generating a signal that indicates the detected weight;

the method comprising:

controlling the driving means by determining an amount of the driving of the driving means by the controlling means by a calculation based on the signal from the load cell such that the inoculants are fed, through the feeding means, to the molten metal that has been poured from the ladle of the automatic molten metal pouring machine into the mold, whereby the inoculants are fed in a predetermined proportion that corresponds to the quantity of the molten metal be poured in a gradual variation.

* * * * *